United States Patent [19]

Cerroni, Manlio

[11] Patent Number: 5,071,544

[45] Date of Patent: Dec. 10, 1991

[54] FILTERING DEVICE FOR SOLID WASTES

[76] Inventor: Cerroni, Manlio, Viale del Poggio Fiorito 63, Rome, Italy

[21] Appl. No.: 422,406

[22] Filed: Oct. 16, 1989

[30] Foreign Application Priority Data

Oct. 14, 1988 [IT] Italy ..... 48456 A/88

[51] Int. Cl.[5] ..... B07B 1/22; B07B 1/50

[52] U.S. Cl. ..... 209/288; 209/379

[58] Field of Search ..... 209/683, 255, 263, 264, 209/284, 288, 379, 392, 397, 270; 210/403

[56] References Cited

U.S. PATENT DOCUMENTS

| | | | |
|---|---|---|---|
| 154,733 | 9/1874 | Warren | 209/379 X |
| 801,703 | 10/1905 | Anderson | 209/270 X |
| 2,122,075 | 6/1938 | Thorold | 209/270 X |
| 3,153,484 | 10/1964 | Heiny | 209/683 |
| 4,509,697 | 4/1985 | Riemann et al. | 209/683 X |

FOREIGN PATENT DOCUMENTS

| | | | |
|---|---|---|---|
| 0895408 | 1/1945 | France | 209/270 |
| 2524824 | 10/1983 | France | 209/270 |
| 1126918 | 5/1986 | Italy . | |
| 0383477 | 8/1973 | U.S.S.R. | 209/288 |

*Primary Examiner*—Michael S. Huppert
*Assistant Examiner*—Edward M. Wacyra
*Attorney, Agent, or Firm*—Watson, Cole, Grindle & Watson

[57] ABSTRACT

A filtering device is provided for solid wastes which includes a rotating drum having longitudinal rows of separating holes located through its outer surface. Plates are located between these rows and extend from the drum at a predetermined height in proportion to the radial dimensions of the holes. The plates can be continuous of discontinuous and can extend either perpendicularly relative to the drum or slightly inclined relative to the drum in a direction opposite the rotation of the drum. If desired, transversely extending plates may also be employed. The plates prevents clogging due to the phenomena of winding wherein fibers exit a hole and re-enter another hole as the drum rotates.

2 Claims, 1 Drawing Sheet

FILTERING DEVICE FOR SOLID WASTES

BACKGROUND OF THE INVENTION

1. Technical Field of the Invention

This invention relates to solid waste disposal and more particularly to filtering devices for solid wastes.

2. Discussion of the Related Art

It is known that solid urban wastes must be subjected as a preliminary step to volumetrical separation and then to qualitative separation where they can be subjected with the necessary treatments to recycle recoverable portions and dispose of the non-recyclable portions.

Volumetric selection is usually done by means of rotating filters which comprise drums or cylinders having mantles provided with holes of various shapes and dimensions. The drum is rotated about its longitudinal axis and this rotation causes material placed inside to be separated according to the size of the material pieces.

In operation, the material pieces which are smaller than the dimensions of the holes pass therethrough, thereby discharging to the outside. On the other hand, the material pieces which exceed the hole dimensions continue across the free end of the drum for subsequent filtering or for final treatment or discharge.

In the case of solid urban wastes, the material placed in the rotating filter often contains scraps, fibers, plastic film, iron filings, and similar elongated bodies. These materials tend to wind themselves around the zone of the mantle of the cylinder between two contiguous holes, thereby clogging the separating holes.

This phenomenon of winding is caused by a filamentary or fibrous material landing across the drum segment between two adjacent holes and partly sticking out from them when these holes are at the lowest point during the rotation of the drum. During this rotation, these fibrous materials are carried in such a way as to move from the lowest to the highest zone. In this highest position, these materials tend to re-enter the drum interior due to the combined effect of the force of gravity ad the centrifugal force of the cylinder created by the aerodynamic effect in the direction opposite to that of the rotation of the drum. This re-entry occurs via both the hole from which they previously exited and from the hole adjacent beside the exited hole in the direction of rotation. This dual re-entry creates tangles around the two holes, thereby obstructing them.

This winding phenomenon is principally observed in the zones between the holes arranged longitudinally relative to one another. The transverse zones are less susceptible to winding, since in that radial direction the effect of the aerodynamic centrifugal force has little influence. Accordingly, the scraps and strings have the tendency to re-enter through the same holes they came out, thereby rendering the holes self-cleaning. Experience has shown that approximately 95% of the winding between two holes is observed in the longitudinal interspaces and 5% in the circumferential spaces.

Winding causes a rapid and progressive clogging of the holes with a consequent reduction of the efficiency of the filtering and the need for frequent and costly cleaning, with significant increase in cost.

In the Italian Patent No. 1,126,918, commonly assigned, winding is prevented by providing appendices in the form of cylindric or conical collars corresponding to all or part of the holes of the filtering surface and the outside of the cylinder. Although satisfactory, the solution envisioned by this patent shows significant inconveniences.

For example, considerable manufacturing costs are incurred, especially due to the fact that the collars are conical. Also, an appropriate projecting of the machines is needed on account of the machine weight, which in turn adds additional weight and therefore requires a greater power source. In spite of the cone shape of the collars, there is a tendency for a moderate quantity of material to re-enter the inside of the filtering cylinder in the phase of passing through some of the holes and the collars. In addition, the determination of the dimensions of the holes requires proceeding through successive approximations case-by-case, thereby frustrating any attempts to improve the filtering process. This is particularly true regarding filtering plants for solid urban waste. Finally, the perforated surface must be periodically changed after abrasion caused by the material, thereby increasing plant operational costs.

Accordingly, it is an object of the present invention to eliminate the phenomena of winding of scraps and/or strings around two contiguous holes of a filtering cylinder via a simple means which does not require special operations to clean the filter itself.

Other objects and advantages will become apparent from these drawings and specification which follow.

SUMMARY OF THE INVENTION

According to the present invention, partitions or channels are placed on the outside of the filtering cylinder perpendicular to the outside surface of the mantle itself and arranged between rows of holes. Preferably, the channels have a height proportionate to the dimensions of the holes. These heights extend perpendicularly to the external surface of the cylinder or transversely inclined with respect to the radial direction of the cylinder, this inclination being in the direction opposite to that of the rotation of the filtering cylinder. Transverse channels or plates may also be provided in addition to the longitudinal plates.

BRIEF DESCRIPTION OF THE DRAWINGS

The invention will now be described and illustrated in detail, corresponding to the attached drawing in which.

DETAILED DESCRIPTION OF THE PREFERRED EMBODIMENTS

Figure 1:
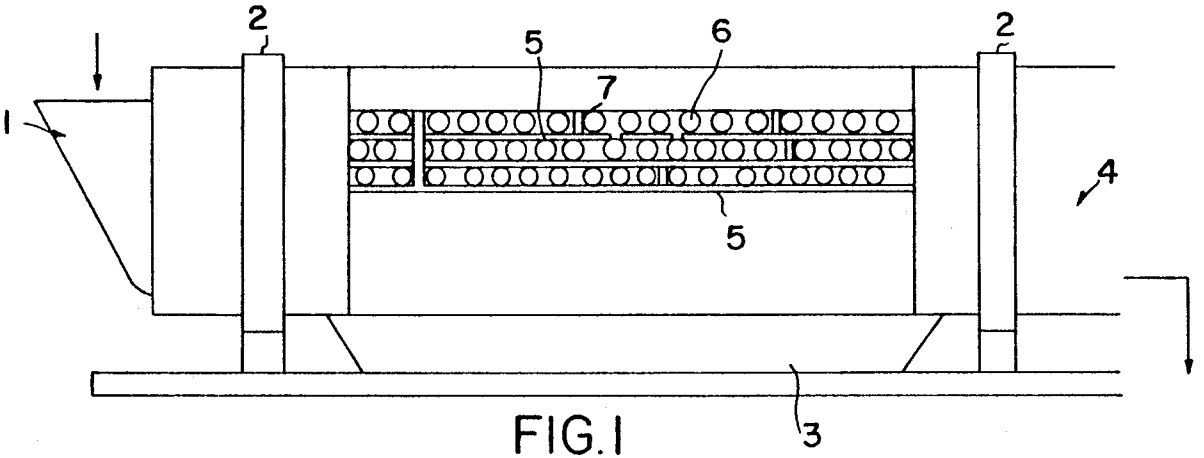
FIG. 1 is a schematic representation of a rotating filter constructed according to the present invention.

A filter according to the present invention comprises a rotating filter cylinder or drum 2 equipped on its mantle with longitudinal rows of holes 6. The material to be filtered enters the interior of cylinder 2 via a feed hopper 1. When the cylinder 2 is rotated about its longitudinal axis, any material contained therein which is smaller than the dimensions of the hole 6 exits the cylinder 2 and is collected in the discharge hopper 3. Residual material which is larger than the hole dimensions passes out of the free end 4 of the cylinder 2.

Figure 2:
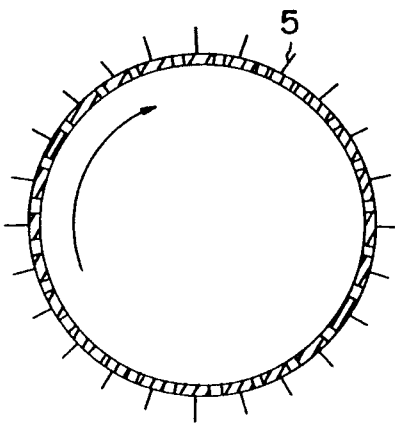
FIG. 2 is a schematic representation of a vertical transverse section of a filtering cylinder according to the present invention.

The cylinder 2 is provided on the outside with longitudinally extending plates 5 set between one row of holes 6 and an adjacent row. Plates 5 create an aureole around cylinder 2, as shown in FIG. 2. If desired, additional plates 7 may be provided in the transverse direction. Plates 5 and/or 7 may be continuous or discontinuous.

Figure 3:
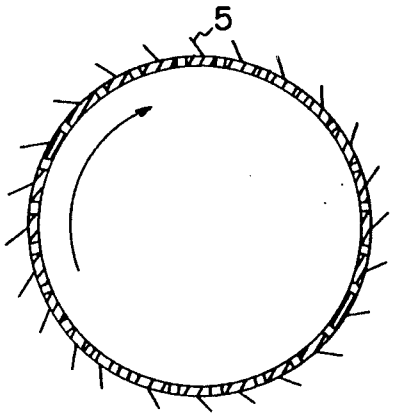
FIG. 3 is a view similar to FIG. 2 of another embodiment of the present invention.

These plates 5 extend from the outside of cylinder 2 with a radial orientation and can be slightly inclined in the direction opposite to that of the rotation of cylinder 2, as shown in FIG. 3. Also, they have a height which is determined as a function of the radial dimensions of the holes, wherein this height is proportionately increased when the radial dimensions of the holes are larger.

With the use of plates 5, there is a self-cleaning action of the holes 6. In conventional filters, all the scraps or fibrous bodies which penetrate into two or more holes 6 and extend across them would tend at every rotation to become wound going in and out of the holes. During rotation, the plates 5 and 7 of the present invention prevent these bodies from entering into a hole other than the one or the ones from which they exited, thereby forcing them back into the cylinder 2.

As previously discussed, the movement of the scraps and fibrous bodies is guided by an aerodynamic force acting centrifugally to the rotating cylinder 2. Thus, the prevention of deviation of the trajectory in this direction suffices to obtain the desired self-cleaning action. Accordingly, the present invention simply and economically reduces plant operation costs.

Although the present invention has been described in reference to preferred embodiments, various modifications and improvements will become apparent to one skilled in the art without departing from the spirit and scope of the invention as defined in the following claims.

I claim:

1. A filtering device comprising:

a rotating drum having longitudinal rows of separating holes located through its outer surface; and a plurality of plates located between the rows of the holes and extending from the outer surface of said rotating drum, wherein some of said plates are located continuously between the rows of holes and some of said plates are located discontinuously between the rows of holes.

2. A filtering device which includes a rotating drum having longitudinal rows of separating holes located through its outer surface, wherein the improvement comprises a plurality of plates located between the rows of holes and extending from the outer surface of the rotating drum, wherein some of said plates are located continuously between the rows of holes and some of said plates are located discontinuously between the rows of holes.

* * * * *